US007392799B2

(12) United States Patent
Fujiyama

(10) Patent No.: US 7,392,799 B2
(45) Date of Patent: Jul. 1, 2008

(54) IGNITION COIL AND METHOD FOR MANUFACTURING THE SAME

(75) Inventor: Norihito Fujiyama, Obu (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 11/826,272

(22) Filed: Jul. 13, 2007

(65) Prior Publication Data

US 2008/0022985 A1 Jan. 31, 2008

(30) Foreign Application Priority Data

Jul. 27, 2006 (JP) ..... 2006-205269
Feb. 6, 2007 (JP) ..... 2007-027151

(51) Int. Cl.
*F02P 3/02* (2006.01)

(52) U.S. Cl. ..... 123/634; 336/92

(58) Field of Classification Search ..... 123/634; 336/92

See application file for complete search history.

(56) References Cited

U.S. PATENT DOCUMENTS 6,178,957 B1 * 1/2001 Widiger et al. ..... 123/634
7,129,812 B2 10/2006 Wada
2003/0122645 A1 * 7/2003 Oosuka et al. ..... 336/96
2003/0136391 A1 * 7/2003 Nakashima et al. ..... 123/634

* cited by examiner

*Primary Examiner*—Erick Solis
(74) *Attorney, Agent, or Firm*—Nixon & Vanderhye PC

(57) ABSTRACT

An ignition coil includes primary and secondary coils. The primary coil includes a primary spool and a primary winding wound on the spool. The primary winding has a second winding layer wound around a first winding layer. The primary spool has first and second overhangs protruding radially outwardly from a first spool end portion of the primary spool. The first overhang is positioned away from the second overhang toward a second spool end portion. The first winding layer has a first winding end portion extending from the first winding layer through a space between the first overhangs, and being wound on the first spool end portion between the first and second overhangs. The second winding layer has a second winding end portion extending from the second winding layer between the first overhangs, and being wound on the first spool end portion between the first and second overhangs.

6 Claims, 6 Drawing Sheets

IGNITION COIL AND METHOD FOR MANUFACTURING THE SAME

CROSS REFERENCE TO RELATED APPLICATION

This application is based on and incorporates herein by reference Japanese Patent Application No. 2006-205269 filed on Jul. 27, 2006 and Japanese Patent Application No. 2007-27151 filed on Feb. 6, 2007.

BACKGROUND OF THE INVENTION

1. Field of the Invention

The present invention relates to an ignition coil for generating a spark between electrodes of a spark plug of an internal combustion engine. The invention also relates to a method for manufacturing the ignition coil.

2. Description of Related Art

An ignition coil for use in an internal combustion engine includes a primary coil, a secondary coil, a center core, and an outer core. The primary coil is provided coaxially with the secondary coil to face with the second coil in a radial direction. The primary coil includes a primary spool and a primary winding, which is wound on the primary spool. The secondary coil includes a secondary spool and a secondary winding, which is wound on the second spool. The center core is provided at an inner peripheral side of the primary and secondary coils, and the outer core is provided at an outer peripheral side of the primary and secondary coils. Both the cores are made of magnetic material. In the above construction, a magnetic circuit is formed through the two cores.

FIGS. 9 and 10 show an ignition coil including a primary coil 92, which includes a primary winding 921 and a primary spool 93 of a conventional structure. The primary spool 93 has circumferential overhangs 933 formed on the outer periphery of its end 932 at the low-voltage end of the primary coil 92. The primary coil 92 includes an inner winding layer 921A and an outer winding layer 921B. The inner winding layer 921A is formed by winding the primary winding 921 around the primary spool 93 from the spool end 932 at the low-voltage coil end to the other spool end at the high-voltage end of the primary coil 92. The outer winding layer 921 B is formed by winding the primary winding 921 around the inner winding layer 921A from the spool end at the high-voltage coil end to the other spool end 932. A first winding end portion 922A of the primary winding 921 for a start of winding engages with one of the circumferential overhangs 933. A second winding end portion 922B of the primary winding 921 for an end of winding engages with another one of the circumferential overhangs 933.

The second winding end portion 922B of the primary winding 921 needs to come into engagement with another one of the circumferential overhangs 933 extending from the outer winding layer 921B, which is wound around the inner winding layer 921 A. This makes it difficult to engage the second winding end portion 922B stably with the circumferential overhang 933 and may loosen the engagement of the second winding end portion 922B.

JP-2005-252233A (corresponding to U.S. Pat. No. 7,129,812) discloses a primary winding and a primary spool, which has multiple circumferential ridges formed at an outer peripheral surface of an upper end, and the primary winding is passed through the space between two of the circumferential ridges. Here, the circumferential ridges are formed so that the primary spool can be fixed firmly in a casing. However, the primary spool is not so devised as to inhibit the second winding end portion of the primary winding from getting loose.

SUMMARY OF THE INVENTION

The present invention is made in view of the above disadvantages. Thus, it is an objective of the present invention to address at least one of the above disadvantages.

To achieve the objective of the present invention, there is provided an ignition coil, which includes a primary coil and a secondary coil. The primary coil includes a primary spool, which is made of a resin to have an annular cross section, and which has a first spool end portion and a second spool end portion. The primary coil includes a primary winding, which is wound on an outer periphery of the primary spool. The primary winding has a first winding layer that is wound around the primary spool from the first spool end portion toward the second spool end portion of the primary spool. The primary winding has a second winding layer, which is continued from the first winding layer, and which is wound around the first winding layer from the second spool end portion toward the first spool end portion of the primary spool. The primary spool has first and second overhangs, which protrude radially outwardly from an outer periphery of the first spool end portion of the primary spool. The first overhang is positioned away from the second overhang toward the second spool end portion. The first overhang is one of a plurality of first overhangs that are circumferentially arranged at the outer periphery of the first spool end portion of the primary spool. The first winding layer has a first winding end portion for a start of winding, which extends from the first winding layer through a space between the first overhangs, and which is wound on the outer periphery of the first spool end portion between the first overhang and the second overhang. The second winding layer has a second winding end portion for an end of winding, which extends from the second winding layer between the first overhangs, and which is wound on the outer periphery of the first spool end portion between the first overhang and the second overhang. The secondary coil generates high voltage when the primary coil is energized.

To achieve the objective of the present invention, there is also provided an ignition coil, which includes a primary coil and a secondary coil. The primary coil includes a primary spool, which is made of a resin to have an annular cross section, and which has a first spool end portion and a second spool end portion. The primary coil includes a primary winding, which is wound on an outer periphery of the primary spool. The primary winding has a first winding layer that is wound around the primary spool from the first spool end portion toward the second spool end portion of the primary spool. The first winding layer has a first winding end portion for a start of winding. The primary winding has a second winding layer, which is continued from the first winding layer, and which is wound on an outer periphery of the first winding layer from the second spool end portion toward the first spool end portion of the primary spool. The second winding layer has a second winding end portion for an end of winding. The primary spool has a first overhang and a second overhang that protrude radially outwardly from an outer periphery the first spool end portion of the primary spool. The first overhang is positioned away from the second overhand toward the second spool end portion for engagement with the first winding end portion of the first winding layer. The second overhang engages with the second winding end portion of the second winding layer. The second winding end portion extends from the second overhang in a direction axially outwardly of the first spool end portion of the primary spool in a condition, where the second winding end portion is wound on the outer periphery of the first spool end portion between the first overhang and the second overhang. The secondary coil generates high voltage when the primary coil is energized.

To achieve the objective of the present invention, there is also provided a method for manufacturing an ignition coil having a primary coil and a secondary coil. Typically, a primary winding is wound on an outer periphery of a primary spool to form the primary coil, and the primary spool is made of a resin to have an annular cross section. In the method, first and second overhangs, which protrude radially outwardly at an outer periphery of a first spool end portion of the primary spool, are formed. The first overhang is positioned away from the second overhang toward a second spool end portion of the primary spool. A first winding end portion of the primary winding for a start of winding is engaged with the first overhang. The primary winding is wound from the first spool end portion toward the second spool end portion of the primary spool to form a first winding layer after the engaging of the first winding end portion. The primary winding is wound on an outer periphery of the first winding layer from the second spool end portion toward the first spool end portion of the primary spool to form a second winding layer. A second winding end portion of the primary winding for an end of winding is engaged with the second overhang to form the primary coil in a condition, where the second winding end portion is wound on the outer periphery of the first spool end portion between the first overhang and the second overhang.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF PREFERRED EMBODIMENTS

An ignition coil and a manufacturing method according to preferred embodiments of the present invention will be described below with reference to the drawings.

Embodiment 1

Figure 1:
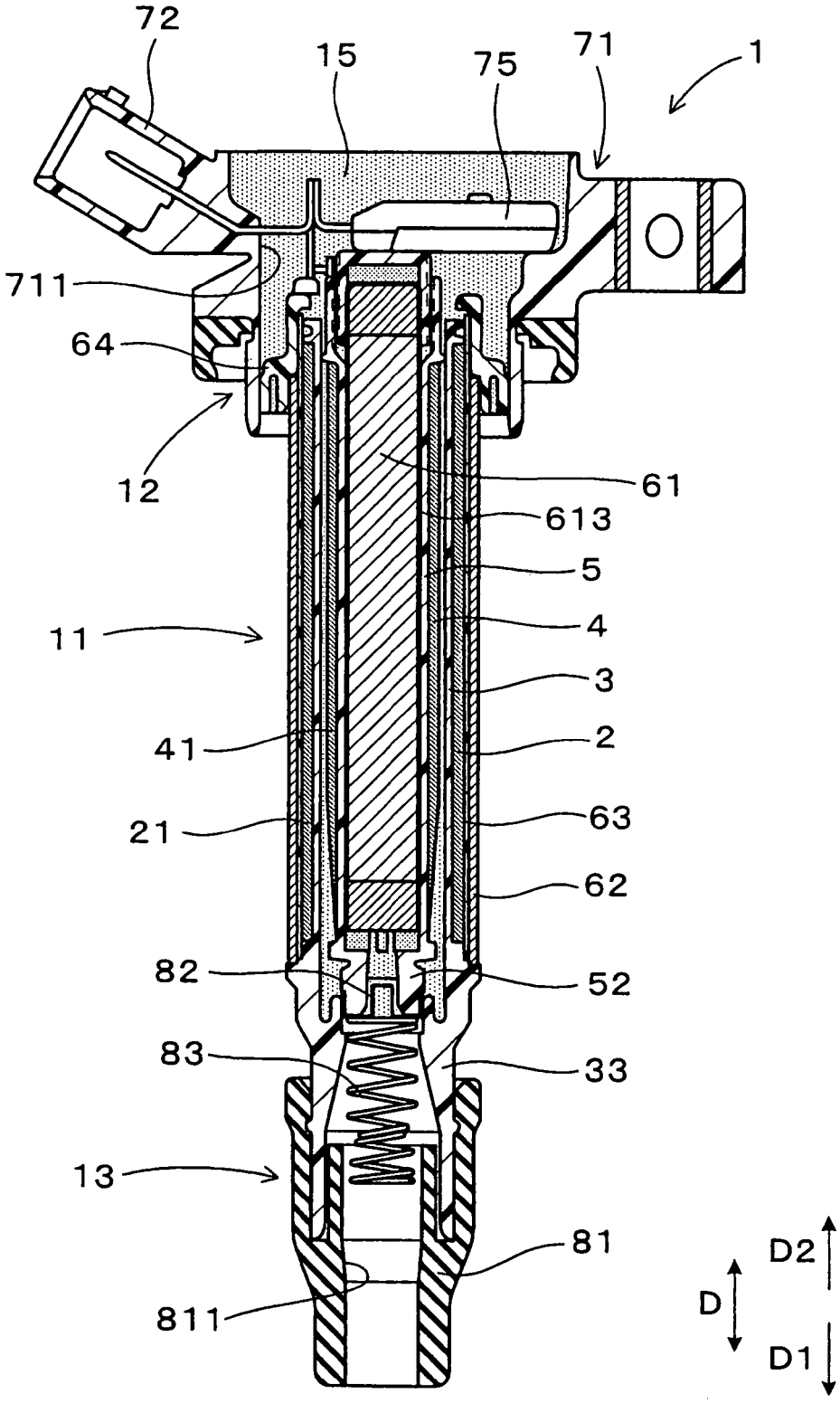
FIG. 1 is an axial section of an ignition coil according to Embodiment 1 of the present invention.

As shown in FIG. 1, an ignition coil 1 according to the present embodiment includes a primary coil 2 and a secondary coil 4. The primary coil 2 includes a primary spool 3 and a primary winding 21. The primary spool 3 is annular in section (i.e., the primary spool 3 has an annular cross section), and is made of a thermoplastic resin. The primary winding 21 is insulatively (dielectrically) coated and wound around the primary spool 3.

Figure 2:
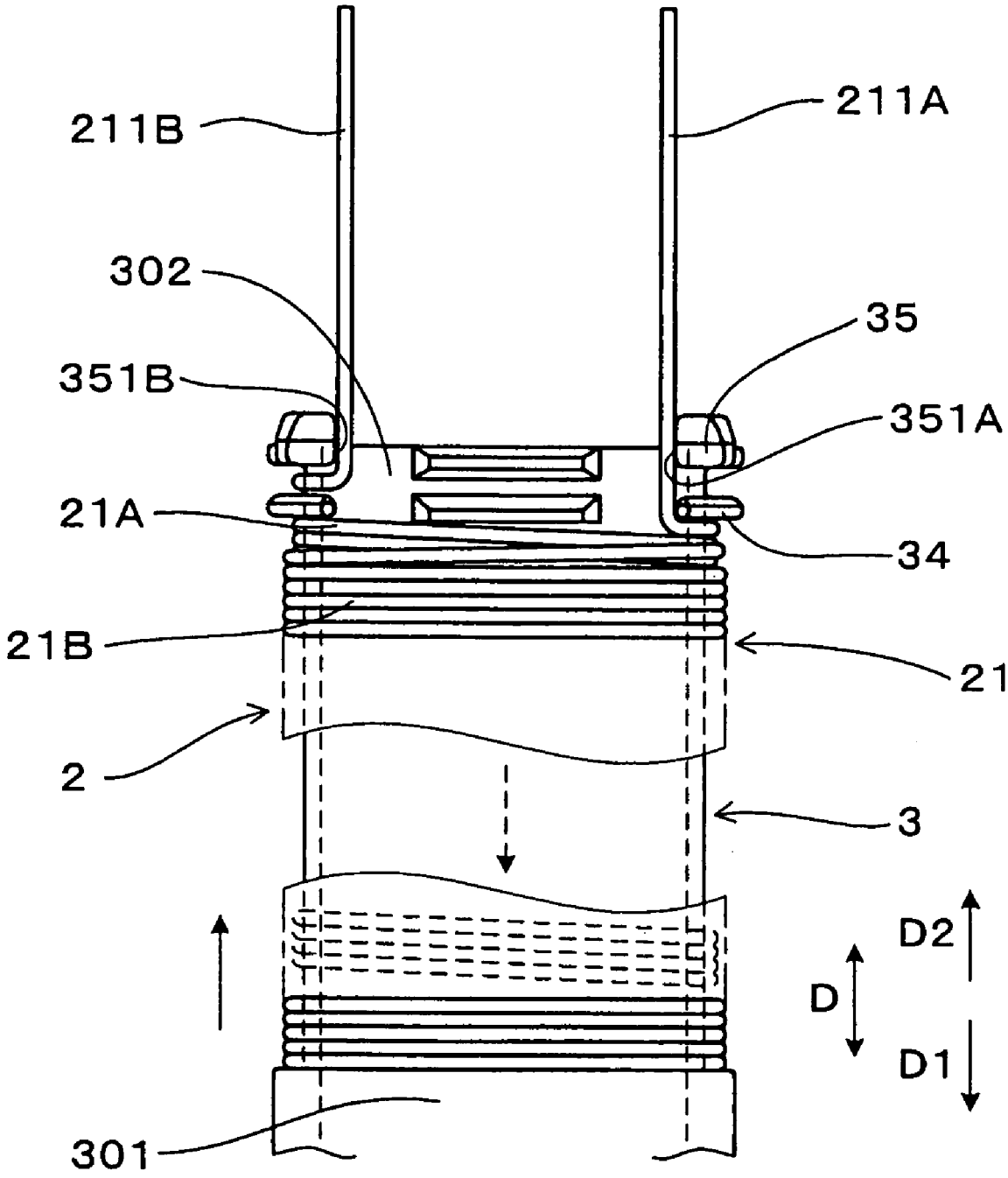
FIG. 2 is a side view of the primary coil of Embodiment 1 as viewed in a direction VI in FIG. 4, the primary coil including a primary spool and a primary winding wound around the primary spool.

As shown in FIG. 2, the primary winding 21 includes an inner winding layer 21A (first winding layer) and an outer winding layer 21B (second winding layer). The inner winding layer 21A is formed by winding the primary winding 21 around the primary spool 3 from an end portion 302 of this spool at the low-voltage end of the primary coil 3 to an end portion 301 of this spool at the high-voltage end of this coil. In other words, the inner winding layer 21A is formed by winding the primary winding 21 at an outer periphery of the primary spool 3 from a first spool end portion 302 at the low-voltage end to a second spool end portion 301 at the high-voltage end of the primary spool 3. Also, the outer winding layer 21B is formed by winding the primary winding 21, which is continued from the inner winding layer 21A, around the inner winding layer 21A from the spool end portion 301 at the high-voltage coil end to the other spool end portion 302.

The primary spool 3 has inner circumferential overhangs 34 (first overhangs) and outer circumferential overhangs 35 (second overhangs) formed on the outer periphery of its end portion 302 at the low-voltage coil end. The outer circumferential overhangs 35 protrude radially outwardly to be positioned at the low-voltage coil end. The inner circumferential overhangs 34 protrude radially outwardly at the low-voltage coil end, and are spaced away from the outer circumferential overhangs 35 in the direction D1 toward the high-voltage coil end. In one embodiment, the outer circumferential overhangs 35 are positioned at an edge of the primary spool 3. A first winding end portion 211A of the primary winding 21 at the inner winding layer 21A engages with one of the inner circumferential overhangs 34. A second winding end portion 211B of the primary winding 21 at the outer winding layer 21B engages with one of the outer circumferential overhangs 35. Typically, the first winding end portion 211A serves as a start of winding of the primary winding 21, and the second winding end portion 211B serves as an end of winding of the primary winding 21.

The second winding end portion 211B is wound around the spool end portion 302 at the low-voltage coil end between one of the inner circumferential overhangs 34 and the adjacent outer circumferential overhang 35, and extends from the outer circumferential overhang 35 in the direction D2 axially outward from this spool end portion 302.

The ignition coil 1 will be described below in detail with reference to FIGS. 1-7.

As shown in FIG. 1, the ignition coil 1 includes a main body 11, a connector 12, and a plug mount 13. The main body 11 includes a coil case 63 housing the primary coil 2 and secondary coil 4. A spark plug is mounted in the plug mount 13, which is fitted to the high-voltage end (IN THE DIRECTION D1) of the main body 11. The connector 12 is fitted to the low-voltage end (IN THE DIRECTION D2) of the main body 11 and connects the ignition coil 1 electrically to the electronic control unit (ECU) of an engine, which is fitted outside the ignition coil.

The ignition coil 1 is of the stick type, and is used in a condition, where the main body 11 and the plug mount 13 are mounted in a plug hole of the engine, and the connector 12 is positioned outside the plug hole.

The connector 12 includes a casing 71 made of a thermoplastic resin and an igniter 75 fitted in the casing. The igniter 75 supplies electric power to the primary winding 21. The connector 12 has a connecting part 72 that projects radially outwardly. Each conductive pin of the igniter 75 is connected electrically to one of the conductive pins insert-molded in the connecting part 72. The casing 71 has a bore 711 formed through it, in which an engaging member 64 made of a thermoplastic resin is fitted. The engaging member 64 engages with the coil body 11.

The igniter 75 has a power supply circuit, an ion current detecting circuit, etc. The power supply circuit supplies electric power to the primary winding 21. The current detecting circuit detects the ion current flowing through the secondary winding 41 when ions flow between a pair of electrodes of the spark plug.

The ignition coil 1 has an ion current detecting function for detecting the ion current generated when ions produced by the combustion in the engine flow between the electrodes of the spark plug. This function is performed by the ion current detecting circuit of the igniter 75. The waveform of the ion current detected by this circuit is processed by the ion current detecting and processing circuit of the ECU, so that it is determined whether the engine has misfired.

As shown in FIG. 1, the secondary coil 4 includes a secondary spool 5 of an annular cross section and made of a thermoplastic resin. The secondary winding 41 is insulatively coated and wound around the secondary spool 5. The secondary winding 41 is thinner than the primary winding 21. The number of turns of the secondary winding 41 is larger than that of the primary winding 21. The secondary winding 41 is wound in an angle. Specifically, the secondary winding 41 is wound in layers at an angle piled toward the high-voltage end (in the direction D1) of the ignition coil 1. The number of turns of the secondary winding 41 at each of the layers decreases toward the high-voltage coil end (in the direction D1).

The two coils 2, 4 surround a center core 61 in the form of a stick, and are surrounded by an outer core 62 in the form of a hollow cylinder (i.e., the two coils 2, 4 are provided outside of the center core 61 and inside of the outer core 62). The two cores 61 and 62 are made of magnetic material. The primary coil 2 surrounds the secondary coil 4, which surrounds the center core 61. The coil case 63 is a hollow cylinder having a thin wall and provided between the primary coil 2 and outer core 62.

The center core 61 has a substantially circular cross section and is formed by laminating flat sheets of electromagnetic steel (silicon steel or the like) radially of the ignition coil 1. The outer core 62 is formed by radially laminating. electromagnetic steel sheets (silicon steel sheets or the like) formed into hollow cylinders in a radially outward direction of the coil case 63. The center core 61 is wound with a stress relaxing sheet 613 of PET (polyethylene terephthalate) or the like.

Figure 4:
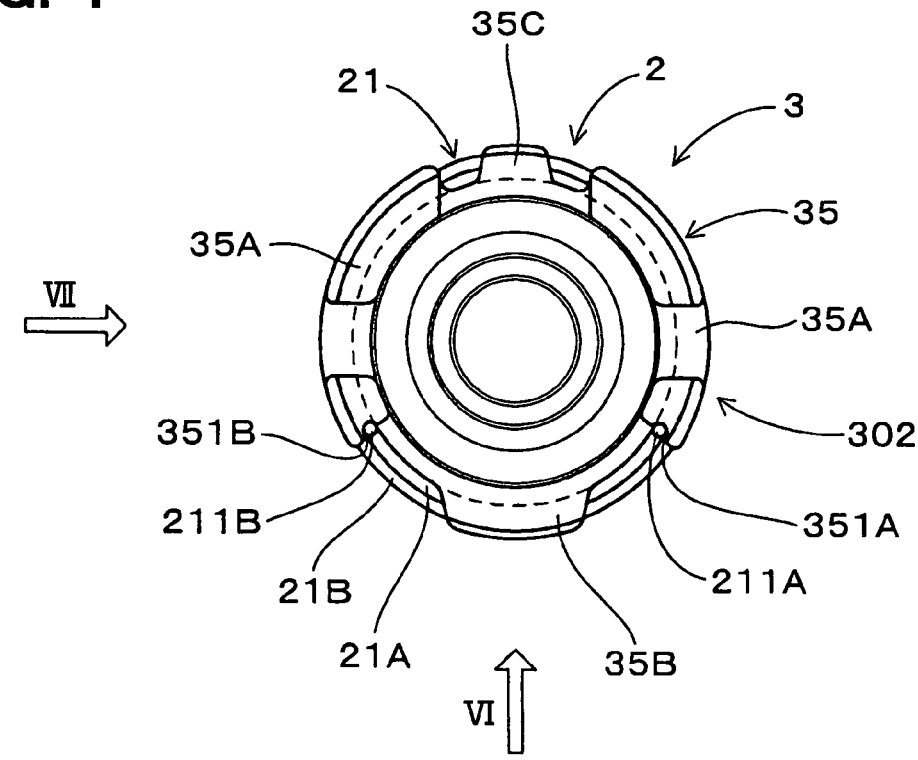
FIG. 4 is an end view of the primary coil of Embodiment 1, showing outer circumferential overhangs of the primary spool, around which the primary winding is wound.
Figure 5:
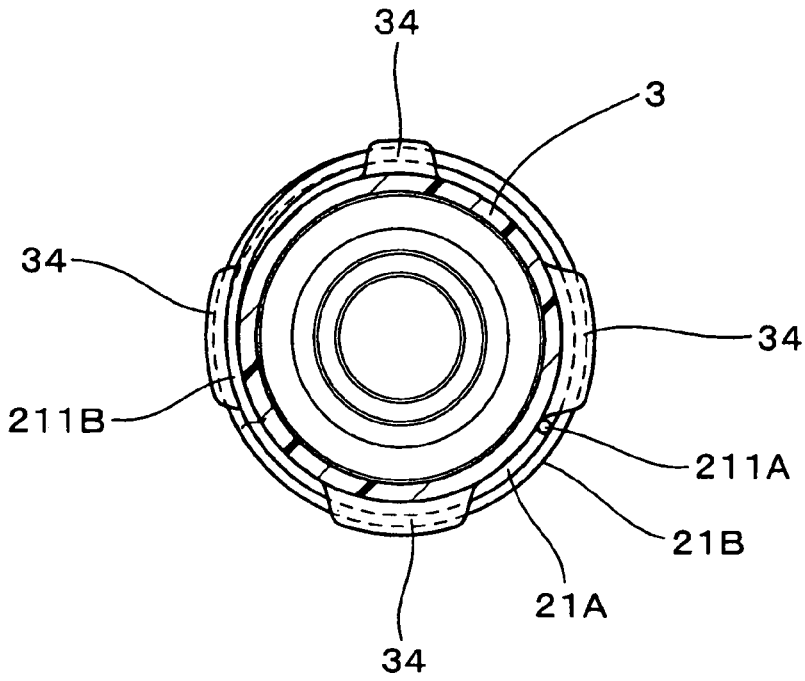
FIG. 5 is a radial section of the primary coil of Embodiment 1, showing inner circumferential overhangs of the primary spool, around which the primary winding is wound.

As shown in FIGS. 4 and 5, the circumferential overhangs 34 and 35 are circumferentially arranged with intervals around the end portion 302 of the primary spool 3 at the low-voltage coil end.

More specifically, as shown in FIG. 4, the outer circumferential overhangs 35 are a pair of first outer circumferential overhangs 35A, a second outer circumferential overhang 35B, and a third outer circumferential overhang 35C. The second outer circumferential overhang 35B is formed between one end of one of the first outer circumferential overhangs. 35A and one end of the other one of the first outer circumferential overhangs. The third outer circumferential overhang 35C is formed between the other ends of the first outer circumferential overhangs 35A. One of the first outer circumferential overhangs 35A has a first recess 351A formed in a circumferential end adjacent to the second outer circumferential overhang 35B. The other first outer circumferential overhang 35A has a second recess 351B formed in a circumferential end adjacent to the second outer circumferential overhang 35B. The first and second winding end portions 211A, 211B of the primary winding 21 engage with the first and second recesses 351A, 351B, respectively.

As shown in FIG. 5, there are four separated inner circumferential overhangs 34.

Figure 3:
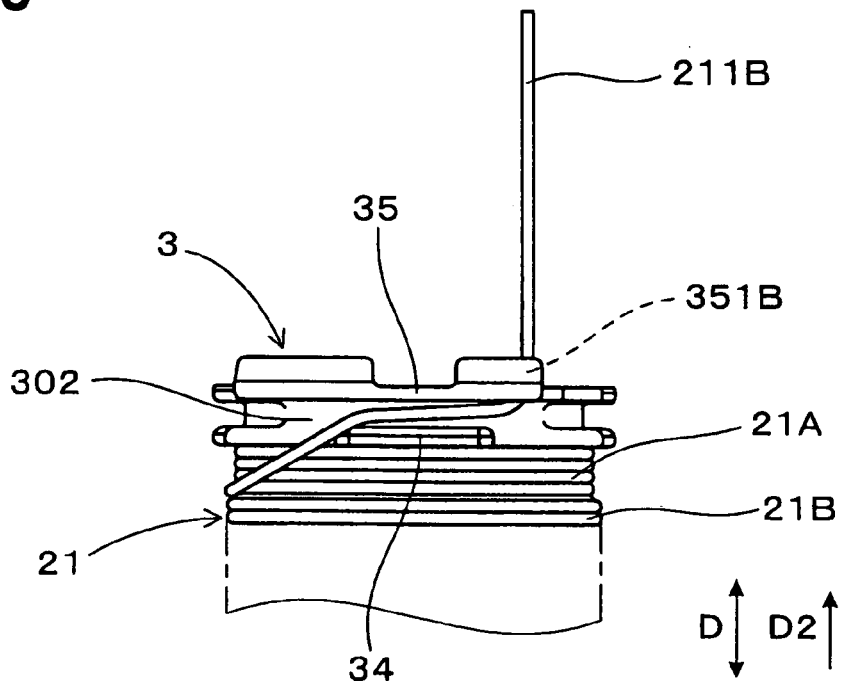
FIG. 3 is a side view of the primary coil of Embodiment 1 as viewed in a direction VII in FIG. 4.

As shown in FIGS. 2 and 3, the second winding end portion 211B extends from the outer winding layer 21B through a space between two inner circumferential overhangs 34 to be provided to a space between the inner circumferential overhang 34 and the outer circumferential overhang 35. Then, the second winding end portion 211B extends through a space between the outer circumferential overhangs 35 in a direction D2 axially outwardly of the spool end portion 302 at the low-voltage coil end of the primary spool 3 in a condition, where the second winding end portion 211B extends through the space between the inner circumferential overhang 34 and the outer circumferential overhang 35 to engage with the second recess 351B. Also, the first winding end portion 211A extends through the space between the outer circumferential overhangs 35 in the direction D2 axially outwardly of the spool end portion 302 at the low-voltage coil end in a condition, where the first winding end portion 211A extends through the space between the inner circumferential overhangs 34 to engage with the first recess 351A.

In this way, the winding end portions 211A, 211B lead (extend) stably in the direction D2 axially outward from the spool end portion 302 at the low-voltage coil end by engaging with the recesses 351A, 351B, respectively.

As shown in FIG. 1, the plug mount 13 consists of a cap mount 33 and a plug cap 81 which is made of a rubber. The cap mount 33 extends from the end of the primary spool 3 at the high-voltage coil end in the direction D1. The plug cap 81 is mounted on the cap mount 33.

The secondary spool 5 has a terminal mount 52 formed on its end at the high-voltage coil end in the direction D1. A high-voltage (secondary) terminal 82 is mounted in the terminal mount 52 and is connected to the high-voltage end of the secondary winding 41. A coil spring 83 is fixed and electrically connected to the high-voltage terminal 82. The terminal of the spark plug (not shown) comes into contact with the coil spring 83. The high-voltage winding end can be connected electrically to the plug terminal (i.e., the terminal portion of the spark plug) via the high-voltage terminal 82 and the coil spring 83.

The cap mount 33 of the primary spool 3 has a holding part formed on its inner periphery. The high-voltage terminal 82 is held between the holding part and the terminal mount 52 of the secondary spool 5.

The plug cap 81 has a bore 811 that extends through the plug cap 81. The spark plug (not shown) is provided with an insulator (dielectric part), which has the plug terminal at one end thereof. The spark plug is fixed to the cylinder head cover of the engine, in a state, where the insulator of the spark plug engages with the cap bore 811, and where the plug terminal contacts the coil spring 83.

As shown in FIG. 1, the spaces in the ignition coil 1, which are surrounded by the coil case 63, the connector 12, the primary spool 3, and the high-voltage terminal 82, are filled with a filler resin 15 (e.g., epoxy resin) as the thermosetting resin.

Specifically, after the parts of the ignition coil 1 are assembled, the spaces in it are evacuated, and then filled with liquid epoxy resin, which is subsequently set (cured).

In response to a pulsed sparking signal for generating the spark from the ECU, an electric current flows through the primary winding 21, such that a magnetic field is formed through the two cores 61 and 62. When the current through the primary winding 21 is cut off, an induction field is formed through the cores 61 and 62, which is opposite in polarity to the magnetic filed. The induction field generates a high-voltage induced electromotive force (back electromotive force) in the secondary winding 41. The electromotive force generates a spark between the electrodes of the spark plug fitted to the ignition coil 1.

Descriptions will be provided below of a process (method) for forming the primary coil 2 to manufacture the ignition coil 1, and of the advantages of the present embodiment.

The circumferential overhangs 34 and 35 are formed in advance on the outer periphery of the end portion 302 of the primary spool 3 at the low-voltage coil end.

Figure 6:
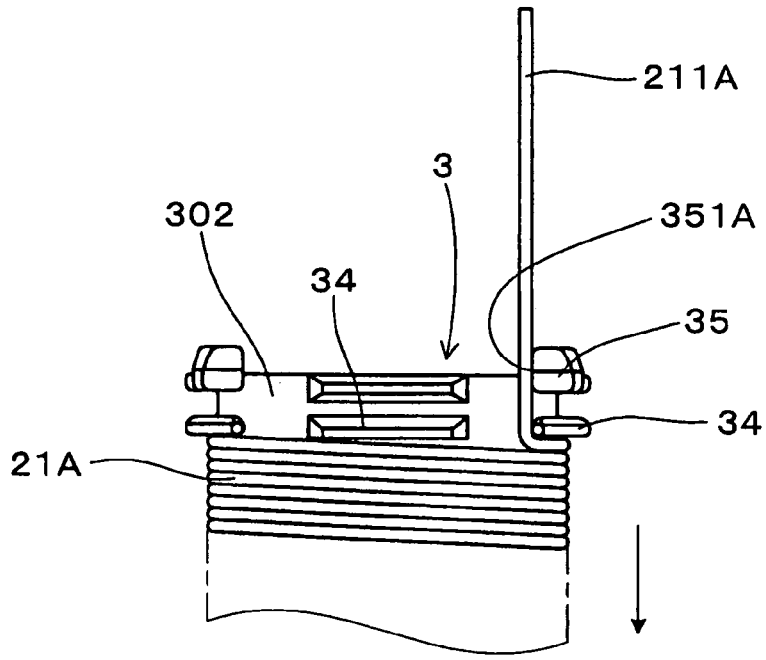
FIG. 6 is a side view of the primary coil of Embodiment 1 as viewed in the direction VI in FIG. 4 showing how an inner winding layer is formed around the primary spool.

With reference to FIG. 6, in the method for winding the primary coil 2 around the primary spool 3, the first winding end portion 211A of the primary winding 21 is engaged with the inner circumferential overhang 34. Subsequently, the primary winding 21 is wound around the primary spool 3 from the spool end portion 302 at the low-voltage coil end toward the spool end portion 301 at the high-voltage coil end, thereby forming the inner winding layer 21A. At this time, the first winding end portion 211A is engaged with the first recess 351A of the outer circumferential overhang 35, and is also engaged with a circumferential end portion of the inner circumferential overhang 34. Therefore, the engagement of the first winding end portion 211A with the first recess 351A and with the end of the inner circumferential overhang 34 limits this portion from getting loose from the spool end portion 302.

Figure 7:
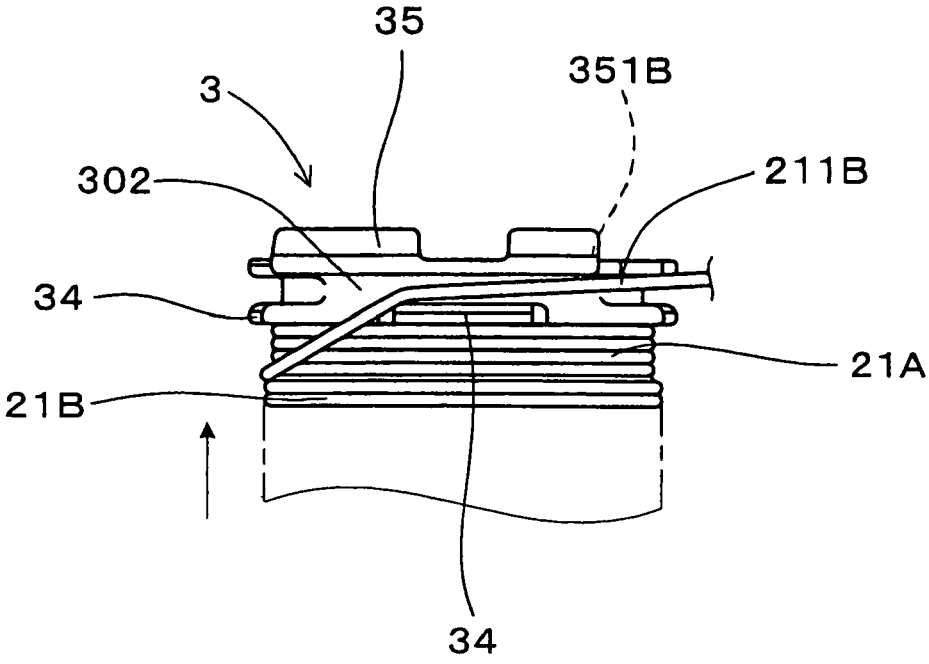
FIG. 7 is a side view of the primary coil of Embodiment 1 as viewed in the direction VII in FIG. 4 showing how an outer winding layer is formed around the primary spool.

Next, as shown in FIG. 7, in the winding process (method), the primary winding 21 is wound around the inner winding layer 21A from the spool end portion 301 at the high-voltage coil end to the spool end portion 302 at the low-voltage coil end of the primary spool 3, thereby the outer winding layer 21B is formed. With reference to FIG. 3, subsequently, the second winding end portion 211B is directly wound around the spool end portion 302 at the low-voltage coil end between the outer circumferential overhang 35 (e.g., the outer circumferential overhang 35 having the second recess 351B) and the adjacent inner circumferential overhang 34. Then, the second winding end portion 211B is engaged with the second recess 351B of the outer circumferential overhang 35. This effectively limits the second winding end portion 211B at the outer winding layer 21B, which is wound around the inner winding layer 21A and which is otherwise likely to get loose, from getting loose from the inner winding layer 21A.

By thus winding the primary winding 21 around the primary spool 3, it is possible to form the primary coil 2, in which the primary winding 21 is limited from getting loose.

Accordingly, the ignition coil 1 and the method for manufacturing this coil make it possible to effectively limit the second winding end portion 211B at the outer winding layer 21B, which is wound around the inner winding layer 21A, from getting loose.

Embodiment 2

A second embodiment of the present invention will be described with reference to the accompanying drawing. Similar components of an ignition coil of the present embodiment, which are similar to the components of the ignition coil of the first embodiment, will be indicated by the same numerals.

Figure 8:
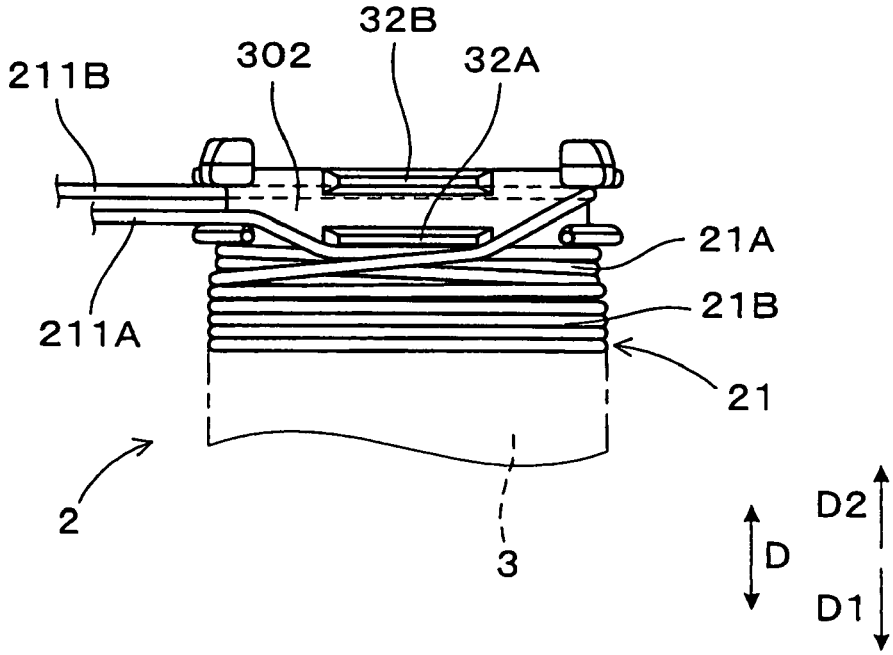
FIG. 8 is a side view of a primary coil of Embodiment 2 of the present invention, the primary coil including a primary spool and a primary winding wound around the primary spool.
Figure 9:
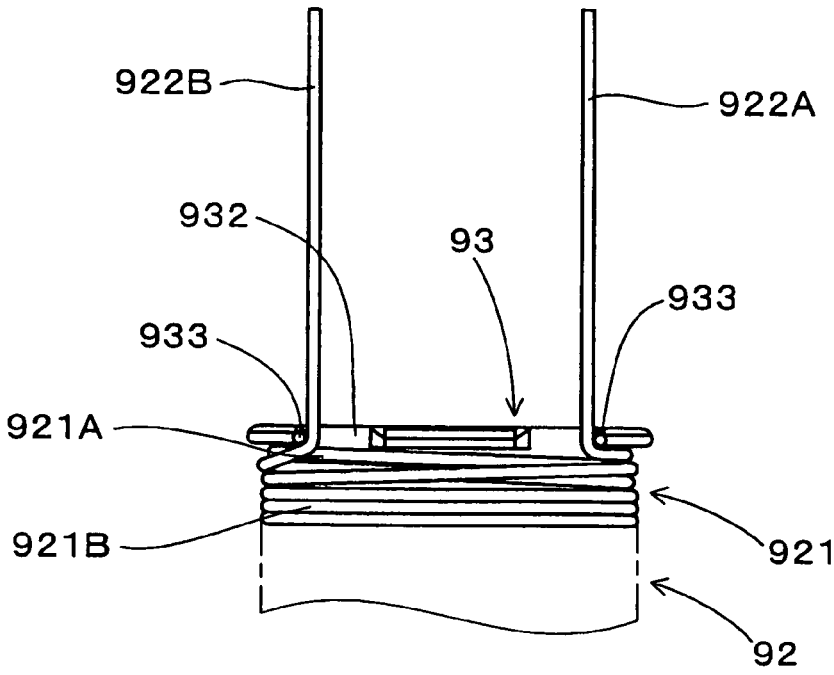
FIG: 9 RELATED ART
FIG. 9 is a side view of a conventional primary coil, which includes a primary spool and a primary winding wound around the spool.
Figure 10:
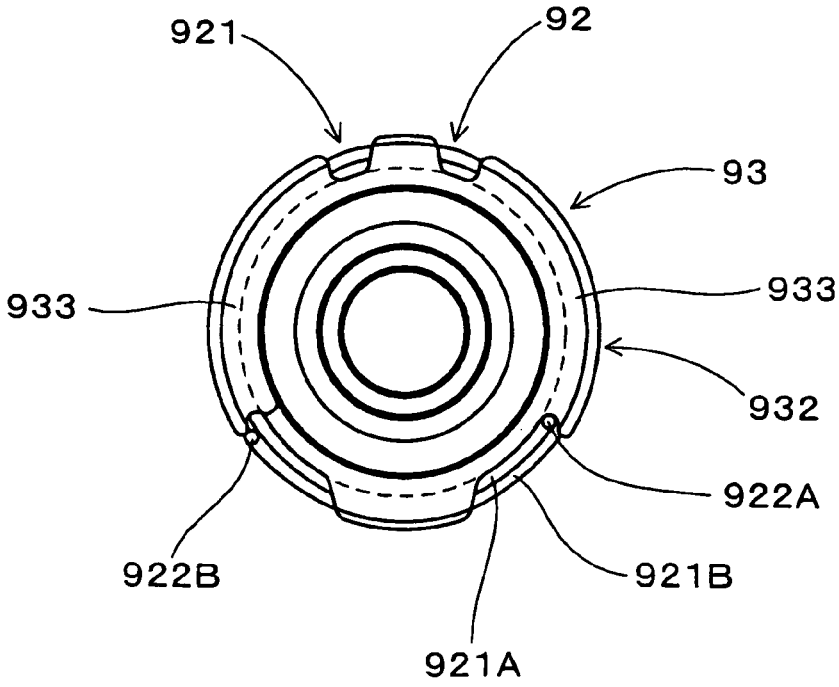
FIG. 10 RELATED ART
FIG. 10 is an end view of a conventional primary coil, showing the circumferential overhangs of the primary spool, around which the primary winding is wound.

FIG. 8 shows another primary coil 2 which limits the second winding end portion 211B of its primary winding 21 at its outer winding layer 21B from getting loose.

The primary spool 3 of this primary coil 2 has inner circumferential overhangs 32A (first overhangs) and outer circumferential overhangs 32B (second overhangs) formed on the outer periphery of the end portion 302 of the primary spool at the low-voltage end of this coil. The outer circumferential overhangs 32B protrude radially outwardly from the primary spool 3 and are positioned at the low-voltage coil end of the primary spool 3. The inner circumferential overhangs 32A protrude radially outwardly from the primary spool 3, and are spaced away from the outer circumferential overhangs 32B in the direction D1 toward the high-voltage end of the primary spool 3. The circumferential overhangs 32A, 32B are circumferentially arranged with intervals around the spool end portion 302 at the low-voltage coil end.

The first winding end portion 211A of this primary winding 21 extends from the inner winding layer 21A through the space between two adjacent inner circumferential overhangs 32A. Then, the first winding end portion 211A is wound around the spool end portion 302 at the low-voltage coil end between the inner circumferential overhang 32A and the outer circumferential overhang 32B. The second winding end portion 211B of this primary winding 21 extends from the outer winding layer 21B through the space between two inner circumferential overhangs 32A. Then, the second winding end portion 211B is wound around the spool end portion 302 at the low-voltage coil end between the inner circumferential overhang 32A and the outer circumferential overhang 32B.

The winding end portions 211A, 211B are wound around the spool end portion 302 at the low-voltage coil end between the inner circumferential overhang 32A and the outer circumferential overhang 32B, and extend radially outwardly of the spool end portion 302 of the primary spool 3.

In the method for forming the inner winding layer 21A of the present embodiment, the first winding end portion 211A is passed through a space between the inner circumferential overhang 32A and the outer circumferential overhang 32B (e.g., a space between the inner circumferential overhang 32A and the adjacent one of the outer circumferential overhangs 32B adjacent to the inner circumferential overhangs 32A). Then, the first winding end portion 211A is passed through a space between the inner circumferential overhangs 32A. Subsequently, the first winding end portion 211A is engaged with a side face of the inner circumferential overhang 32A, which faces toward the spool end portion 301 at the high-voltage coil end. Subsequently, the primary winding 21 is wound around the primary spool 3 toward the high-voltage spool end. In the method for forming the outer winding layer 21B of the present embodiment, the primary winding 21 is wound around the inner winding layer 21A back toward the spool end portion 302 at the low-voltage coil end, and then the second winding end portion 211B is passed through the space between two adjacent inner circumferential overhangs 32A, and then through the space between the inner circumferential overhang 32A and the outer circumferential overhang 32B.

As above, the first winding end portion 211A and the second winding end portion 211B extend radially outwardly of the spool end portion 302 of the primary spool 3. However, alternatively, the first winding end portion 211A and the second winding end portion 211B may extend from the outer overhang 32B in a direction axially outwardly of the spool end portion 302 in one modification example. The ignition coils according to the present embodiment and to the modification example as well make it possible to effectively limit the second winding end portion 211B at the outer winding layer 21B, which surrounds the inner winding layer 21A, from getting loose.

Other structure of the present embodiment other than the above is otherwise similar in structure to Embodiment 1 and has advantages similar to those of Embodiment 1.

Additional advantages and modifications will readily occur to those skilled in the art. The invention in its broader terms is therefore not limited to the specific details, representative apparatus, and illustrative examples shown and described.

What is claimed is:

1. An ignition coil comprising:

a primary coil that includes a primary spool, which is made of a resin to have an annular cross section, and which has a first spool end portion and a second spool end portion, the primary coil including a primary winding, which is wound on an outer periphery of the primary spool, wherein the primary winding has a first winding layer that is wound around the primary spool from the first spool end portion toward the second spool end portion of the primary spool, wherein the primary winding has a second winding layer, which is continued from the first winding layer, and which is wound around the first winding layer from the second spool end portion toward the first spool end portion of the primary spool, wherein the primary spool has first and second overhangs, which protrude radially outwardly from an outer periphery of the first spool end portion of the primary spool, the first overhang being positioned away from the second overhang toward the second spool end portion, wherein the first overhang is one of a plurality of first overhangs that are circumferentially arranged at the outer periphery of the first spool end portion of the primary spool, wherein the first winding layer has a first winding end portion for a start of winding, which extends from the first winding layer through a space between the first overhangs, and which is wound on the outer periphery of the first spool end portion between the first overhang and the second overhang, and wherein the second winding layer has a second winding end portion for an end of winding, which extends from the second winding layer between the first overhangs, and which is wound on the outer periphery of the first spool end portion between the first overhang and the second overhang; and a secondary coil that generates high voltage when the primary coil is energized.

2. The ignition coil according to claim 1, wherein:

the first winding end portion of the first winding layer and the second winding end portion of the second winding layer extend radially outwardly from the primary spool at the first spool end portion in a condition, where the first winding end portion and the second winding end portion are wound on the outer periphery of the first spool end portion between the first overhang and the second overhang.

3. The ignition coil according to claim 1, wherein:

the first winding end portion of the first winding layer and the second winding end portion of the second winding layer extend from the second overhang in a direction axially outwardly of the first spool end portion of the primary spool in a condition, where the first winding end portion and the second winding end portion are wound on the outer periphery of the first spool end portion between the first overhang and the second overhang.

4. An ignition coil comprising:

a primary coil that includes a primary spool, which is made of a resin to have an annular cross section, and which has a first spool end portion and a second spool end portion, the primary coil including a primary winding, which is wound on an outer periphery of the primary spool, wherein the primary winding has a first winding layer that is wound around the primary spool from the first spool end portion toward the second spool end portion of the primary spool, the first winding layer having a first winding end portion for a start of winding, wherein the primary winding has a second winding layer, which is continued from the first winding layer, and which is wound on an outer periphery of the first winding layer from the second spool end portion toward the first spool end portion of the primary spool, the second winding layer having a second winding end portion for an end of winding, wherein the primary spool has a first overhang and a second overhang that protrude radially outwardly from an outer periphery the first spool end portion of the primary spool, the first overhang being positioned away from the second overhand toward the second spool end portion for engagement with the first winding end portion of the first winding layer, the second overhang engaging with the second winding end portion of the second winding layer, and wherein the second winding end portion extends from the second overhang in a direction axially outwardly of the first spool end portion of the primary spool in a condition, where the second winding end portion is wound on the outer periphery of the first spool end portion between the first overhang and the second overhang; and a secondary coil that generates high voltage when the primary coil is energized.

5. The ignition coil according to claim 4, wherein the first overhang is one of a plurality of first overhangs that are circumferentially arranged at the outer periphery of the first spool end portion, wherein the second overhang is one of a plurality of second overhangs that are circumferentially arranged at the outer periphery of the first spool end portion, wherein the first winding end portion extends through a space between the first overhangs and through a space between the second overhangs in a direction axially outwardly of the first spool end portion, wherein the second winding end portion extends from the second winding layer through a space between the first overhangs to be provided to a space between the first overhang and the second overhang, the second winding end portion extending through the space between the first overhang and the second overhang, the second winding end portion extending through a space between the second overhangs in the direction axially outwardly of the first spool end portion, wherein one of the plurality of second overhangs has a first recess at an end portion of the one of the plurality of second overhangs in a circumferential direction of the primary spool for engagement with the first winding end portion, and wherein another one of the plurality of second overhangs has a second recess at an end portion of the another one of the plurality of second overhangs in an opposite circumferential direction of the primary spool for engagement with the second winding end portion.

6. A method for manufacturing an ignition coil having a primary coil and a secondary coil, a primary winding being wound on an outer periphery of a primary spool to form the primary coil, the primary spool being made of a resin to have an annular cross section, the method comprising:

forming first and second overhangs, which protrude radially outwardly at an outer periphery of a first spool end portion of the primary spool, the first overhang being positioned away from the second overhang toward a second spool end portion of the primary spool;

engaging a first winding end portion of the primary winding for a start of winding with the first overhang;

winding the primary winding from the first spool end portion toward the second spool end portion of the primary spool to form a first winding layer after the engaging of the first winding end portion;

winding the primary winding on an outer periphery of the first winding layer from the second spool end portion toward the first spool end portion of the primary spool to form a second winding layer; and engaging a second winding end portion of the primary winding for an end of winding with the second overhang to form the primary coil in a condition, where the second winding end portion is wound on the outer periphery of the first spool end portion between the first overhang and the second overhang.

* * * * *